US011589179B2

(12) United States Patent
Rusconi Clerici Beltrami et al.

(10) Patent No.: US 11,589,179 B2
(45) Date of Patent: Feb. 21, 2023

(54) TEST DEVICE FOR TESTING A MICROPHONE

(71) Applicant: USound GmbH, Graz (AT)

(72) Inventors: Andrea Rusconi Clerici Beltrami, Vienna (AT); Ferruccio Bottoni, Graz (AT); Markus Bartek, Vienna (AT)

(73) Assignee: USound GmbH, Graz (AT)

( * ) Notice: Subject to any disclaimer, the term of this patent is extended or adjusted under 35 U.S.C. 154(b) by 0 days.

(21) Appl. No.: 17/326,521

(22) Filed: May 21, 2021

(65) Prior Publication Data

US 2021/0377682 A1 Dec. 2, 2021

(30) Foreign Application Priority Data

May 26, 2020 (DE) ..... 102020114091.6

(51) Int. Cl.
*H04R 29/00* (2006.01)
*H04R 19/04* (2006.01)

(52) U.S. Cl.
CPC ..... *H04R 29/005* (2013.01); *H04R 19/04* (2013.01); *H04R 2201/003* (2013.01); *H04R 2499/11* (2013.01)

(58) Field of Classification Search
CPC ..... H04R 29/005; H04R 19/04; H04R 2201/003; H04R 2499/11; H04R 1/08; H04R 29/004; H04R 29/002; H04R 5/02
See application file for complete search history.

(56) References Cited

U.S. PATENT DOCUMENTS 5,703,797 A * 12/1997 Russell ..... H04R 29/00 702/77
8,144,884 B2 * 3/2012 Van den Heuvel .. H04R 29/004 381/322
8,995,674 B2 * 3/2015 Frye ..... H04R 29/00 381/345
9,247,366 B2 * 1/2016 Doller ..... H04R 29/004
9,400,262 B2 * 7/2016 Doller ..... B81C 99/005
2011/0226544 A1 * 9/2011 Viehmann ..... H04R 29/004 181/198

(Continued)

FOREIGN PATENT DOCUMENTS

DE 102007059279 B3 1/2010
DE 11 2018 000 543 T5 10/2019

(Continued)

OTHER PUBLICATIONS

German Search Report dated May 26, 2020, 10 pages.
EPO Search Report, dated Oct. 21, 2021, 10 pages.

*Primary Examiner* — Oyesola C Ojo
(74) *Attorney, Agent, or Firm* — Dority & Manning, P.A.

(57) ABSTRACT

A test device for testing a microphone has at least one test loudspeaker for generating at least one test tone into at least one test cavity. The test device has a compartment for accommodating the microphone to be tested in acoustic communication with the test cavity. The test device has at least one reference microphone for ascertaining a reference signal of the test tone emitted from the test loudspeaker. The test device has a reference cavity separated from the test cavity and acoustically coupled with the reference microphone and the test cavity. The test loudspeaker is arranged between the reference microphone and the test loudspeaker.

17 Claims, 4 Drawing Sheets

(56) References Cited

U.S. PATENT DOCUMENTS

| | | | | |
|---|---|---|---|---|
| 2013/0321011 | A1 | 12/2013 | Binder | |
| 2014/0328489 | A1* | 11/2014 | Ziegler | H04R 29/004 381/58 |
| 2015/0117654 | A1* | 4/2015 | John | H04R 29/004 381/59 |
| 2016/0198276 | A1* | 7/2016 | Stetson | H04R 29/004 381/58 |
| 2019/0132684 | A1* | 5/2019 | Cole | H04R 25/30 |
| 2021/0120352 | A1* | 4/2021 | Khenkin | H04R 29/004 |

FOREIGN PATENT DOCUMENTS

| | | | | |
|---|---|---|---|---|
| WO | WO 2009/071596 | A1 | 6/2009 | |
| WO | WO-2009071596 | A1 * | 6/2009 | B81C 99/005 |
| WO | WO-2010026724 | A1 * | 3/2010 | G01H 17/00 |
| WO | WO-2013001316 | A1 * | 1/2013 | H04R 29/004 |
| WO | WO 2016/111983 | A1 | 7/2016 | |
| WO | WO 2018/190818 | A1 | 4/2017 | |

* cited by examiner

TEST DEVICE FOR TESTING A MICROPHONE

The present invention relates to a test device for testing a microphone, with at least one test loudspeaker for generating at least one test tone into at least one test cavity. the test device has at least one accommodating area for accommodating the microphone to be tested and at least one reference microphone for ascertaining a reference signal of the test tone emitted from the test loudspeaker.

BACKGROUND OF THE INVENTION

A test system for a microphone is made known in WO 2016/111983 A1, which corresponds to US Patent Application Publication Nos. 2016-0198276 and 2017-0048636, which are hereby incorporated herein in their entireties by this reference for all purposes. The test device includes a test loudspeaker, which can emit a test tone into a test chamber. The microphone to be tested and a reference microphone are arranged in the test chamber.

OBJECTS AND SUMMARY OF THE INVENTION

The object of the present invention is therefore to improve the related art.

The object is achieved by means of a test device having one or more of the features described below.

The invention relates to a test device for testing a microphone. A check can therefore be carried out, for example, to determine whether the microphone picks up a tone with distortion, and so this non-functional microphone can be rejected.

The test device includes at least one test loudspeaker for generating at least one test tone. By means of the test loudspeaker, a test sequence can also be generated, which can include multiple test tones of various frequencies and/or sound levels. The test tone is detected by the microphone to be tested, which then generates a signal. This signal can be evaluated, in order to check the correct functioning of the microphone.

Furthermore, the test device includes at least one test cavity, into which the test loudspeaker can emit the test tone.

The test device includes at least one accommodating area for accommodating the microphone to be tested, which is designed in such a way that the microphone to be tested can be acoustically coupled to the test cavity. Therefore, when the microphone to be tested is inserted into the test device, the microphone is in an acoustic connection with the test cavity. The microphone to be tested can therefore be coupled to the test cavity. The microphone to be tested can therefore detect the test tone in the test cavity. When the microphone to be tested is arranged in the accommodating area, it is therefore connected to the test cavity and/or is coupled to the test cavity. For example, the accommodating area is a portion of the test cavity and/or, for example, the accommodating area delimits the test cavity. The accommodating area can also be arranged in such a way that the microphone to be tested, when located in the accommodating area, is arranged in the test cavity. When the microphone to be tested is located in the accommodating area, it can detect the test tone.

In addition, the test device includes at least one reference microphone for ascertaining a reference signal of the test tone emitted from the test loudspeaker. With the aid of the reference microphone, a check can be carried out, for example, to determine whether the test loudspeaker has emitted the correct test tone. For example, the test loudspeaker itself could be defective, which can be checked with the aid of the reference microphone.

According to the invention, the test device includes a reference cavity separated from the test cavity, into which the test tone can also be emitted and to which the reference microphone is acoustically coupled for ascertaining the reference signal. As a result, the microphone to be tested can detect the test tone in the test cavity and the reference microphone can detect the test tone in the reference cavity. The two measurements are therefore decoupled from one another, and so they do not, or only slightly, affect each other.

Additionally or alternatively, according to the invention, the accommodating area is arranged on a first side of the test loudspeaker and the reference microphone is arranged on a second side of the test loudspeaker opposite the first side. Therefore, the test loudspeaker is arranged between the reference microphone and the accommodating area and the microphone to be tested when the microphone to be tested is located in the accommodating area. The test loudspeaker is therefore also arranged between the reference microphone and the test cavity. Consequently, a compact design of the test device is achieved when the microphone to be tested is situated in the accommodating area.

Due to the arrangement of the reference microphone on the second side of the test loudspeaker, a sandwich design is achieved, which also results in a compact design.

The test cavity can therefore be arranged on the first side of the test loudspeaker and the reference cavity can be arranged on the second side of the test loudspeaker.

It is advantageous when the test loudspeaker is designed in such a way that it can emit the test tone in the direction of its first side and in the direction of its second side. Additionally or alternatively, it is advantageous when the test loudspeaker is designed in such a way that it can emit the test tone into the test cavity and into the reference cavity. Additionally or alternatively, it is advantageous when the test loudspeaker is arranged in such a way that it can emit the test tone in the direction of its first side and in the direction of its second side. Consequently, the test tone is emitted to the microphone to be tested and to the reference microphone. The microphone to be tested and the reference microphone therefore both detect the same test tone, and so the two detected signals are comparable.

It is advantageous when the reference cavity is arranged on the second side of the test loudspeaker.

It is advantageous when the test loudspeaker includes a diaphragm, by means of which the test tone can be emitted into the test cavity. Additionally or alternatively, the diaphragm can also emit the test tone into the reference cavity. The diaphragm is made to vibrate, and so the air in the test cavity and/or in the reference cavity is made to vibrate and, consequently, the test tone is formed.

Desirably, the diaphragm can be arranged between the test cavity and the reference cavity. Due to the oscillation of the diaphragm, the test tone is simultaneously generated in the test cavity and the reference cavity. Additionally or alternatively, the diaphragm can also separate the test cavity and the reference cavity from one another. As a result, acoustic properties of the one cavity have no effect on the other cavity.

It is advantageous when the test device includes an accommodating device for accommodating the microphone to be tested, which includes the accommodating area. The accommodating device can be arranged on the first side of the test loudspeaker. The accommodating device can include, for example, a recess, into which the microphone to be tested can be arranged. The accommodating device and/or the recess can be designed in such a way that they can accommodate the microphone to be tested.

Furthermore, the accommodating device of the compartment can preferably include a fixing device that is configured to receive and hold the microphone to be tested in a disposition that is suitable for the testing to take place as intended. As a result, it can be ensured that the microphone does not detach from the test device during testing.

Additionally or alternatively, the test device can also include the fixing device.

By means of the fixing device, the microphone to be tested also can be fixed in a force-locked and/or form-locking manner. The fixing device can include, for example, a spring element, by means of which the microphone to be tested is fixed.

It is advantageous when the test cavity is at least partially formed by means of a front volume of the test loudspeaker. Additionally or alternatively, the test cavity can be at least partially formed by means of a passage of the accommodating device and/or of the accommodating area. Additionally or alternatively, the test cavity can be at least partially formed by means of a first detection volume of the microphone to be tested. As a result, already present volumes can be utilized.

It is advantageous when the reference cavity is at least partially formed by a back volume of the test loudspeaker. Additionally or alternatively, the reference cavity can also be formed by a second detection volume of the reference microphone. As a result, already present volumes can be utilized.

It is advantageous when the test cavity and the reference cavity are spaced apart from one another in an axial direction of the test device. Additionally or alternatively, it is advantageous when the at least one test loudspeaker is arranged between the test cavity and the reference cavity.

It is advantageous when the front volume, the passage of the accommodating device and/or of the accommodating area, and/or the first detection volume are arranged coaxially, in particular congruently, with one another. It is to be noted here and also for the following description that the first detection volume belongs to the microphone to be tested. The design of the first detection volume can therefore be affected only slightly or not at all. Rather, however, the aforementioned volumes and/or the passage can be adapted to the first detection volume. The front volume and/or the passage can be designed in such a way that they are arranged, with respect to the first detection volume, coaxially, in particular congruently, with one another when the microphone to be tested is tested. Due to the coaxial and/or congruent design, for example, scatterings at edges can be avoided.

Additionally or alternatively, the back volume and the second detection volume can be arranged coaxially, in particular, congruently, with one another. As a result, as described above, for example, scatterings can be reduced. Scatterings can also be avoided as a result.

Additionally or alternatively, the front volume, the passage, the back volume, the first detection volume and/or the second detection volume can have a round cross-section.

It is advantageous when the front volume, the passage, the first detection volume, and/or the diaphragm are arranged offset with respect to each other in the transverse direction. Additionally or alternatively, the back volume, the second detection volume, and/or the diaphragm are arranged offset with respect to each other in the transverse direction.

It is advantageous when the diaphragm of the at least one test loudspeaker is arranged oriented in the transverse direction. In addition, the diaphragm of the at least one test loudspeaker can extend transversely, in particular perpendicularly, to the axial direction. Consequently, the generated sound waves are radiated in the axial direction.

It is advantageous when the diaphragm has a larger area than a cross-sectional area of the front volume. The area of the diaphragm or the diaphragm itself and the cross-sectional area can be parallel to one another. Additionally or alternatively, the diaphragm can also have a larger area than a cross-sectional area of the passage. Additionally or alternatively, the diaphragm can also have a larger area than a cross-sectional area of the back volume. Additionally or alternatively, the diaphragm can also have a larger area than a cross-sectional area of the test cavity. Additionally or alternatively, the diaphragm can also have a larger area than a cross-sectional area of the reference cavity. Additionally or alternatively, the diaphragm can also have a larger area than a cross-sectional area of the first detection volume. Additionally or alternatively, the diaphragm can also have a larger area than a cross-sectional area of the second detection volume. The cross-sectional areas of the aforementioned volumes can be parallel to one another. The area of the diaphragm can preferably refer to the area facing the corresponding volume or the corresponding cavity. This has the advantage, at the passage by way of example, that the diaphragm is larger than the passage, and so the sound waves generated by the diaphragm must pass through the smaller passage, wherein the sound pressure increases.

It is advantageous when a volume of the front volume is larger than a volume of the passage. Additionally or alternatively, it is advantageous when the volume of the front volume is greater than a volume of the first detection volume.

Additionally or alternatively, it is advantageous when a volume of the back volume is greater than a volume of the second detection volume. Due to the greater volume of the front volume in comparison to the passage and/or the first detection volume, a sound pressure generated by the test loudspeaker is increased when the sound from the front volume enters the passage and/or the first detection volume. The same applies for the back volume and the second detection volume. As a result, high sound pressures can be formed for testing the microphone.

It is advantageous when at least two test loudspeakers are arranged one above the other in an axial direction of the test device. As a result, the test tone can be amplified.

It is advantageous if, in the case of two test loudspeakers arranged one above the other, the back volume of one test loudspeaker is arranged coaxially, in particular congruently, with the front volume of the other test loudspeaker. As a result, for example, scatterings can be reduced in this case as well.

It is advantageous when the at least one test loudspeaker, the at least one reference microphone, and/or the at least one accommodating device are arranged in a housing. Furthermore, the accommodating device and the housing can also be designed as one piece.

It is advantageous when multiple microphones can be tested by means of the test device. As a result, a plurality of microphones can be tested simultaneously. Additionally or alternatively, multiple microphones can be accommodated, for example, in the accommodating area.

It is advantageous when the test device includes multiple accommodating areas, multiple test loudspeakers, multiple test cavities, multiple reference microphones, and/or multiple reference cavities, in order to test multiple microphones. The elements required for testing a microphone are multiplied in this case, and so multiple microphones can be tested simultaneously. In order to test multiple microphones, the test device can be designed, for example, in such a way that the microphones can be arranged next to one another, in particular in a planar manner. For example, for this purpose, multiple accommodating areas can be arranged next to one another, in particular in a planar manner.

It is advantageous when the microphone to be tested is a MEMS microphone.

Additionally or alternatively, the at least one test loudspeaker can be a MEMS loudspeaker and/or an electrodynamic loudspeaker.

Additionally or alternatively, the at least one reference microphone can be a MEMS microphone, an electrostatic microphone, and/or a condenser microphone.

BRIEF DESCRIPTION OF THE DRAWINGS

Further advantages of the invention are described in the following exemplary embodiments. In the drawings.

DETAILED DESCRIPTION OF EXEMPLARY EMBODIMENTS

Figure 1:
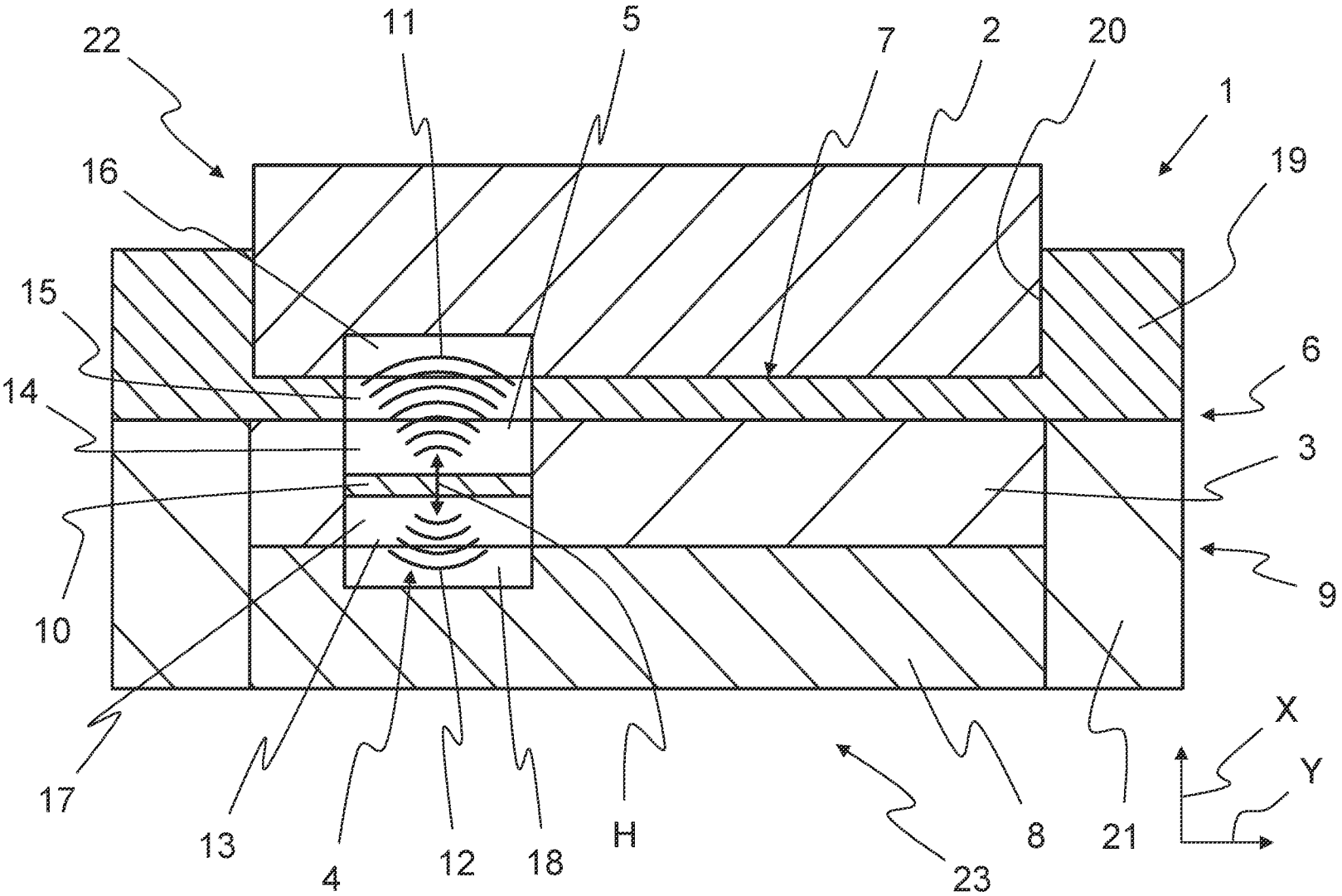
FIG. 1 shows a schematic sectional view of a test device for testing a microphone.

FIG. 1 shows a schematic sectional view of a test device 1 for testing a microphone 2. In order to provide a better explanation, the microphone 2 to be tested is arranged or inserted into the test device 1 in the view depicted in FIG. 1.

Figure 2:
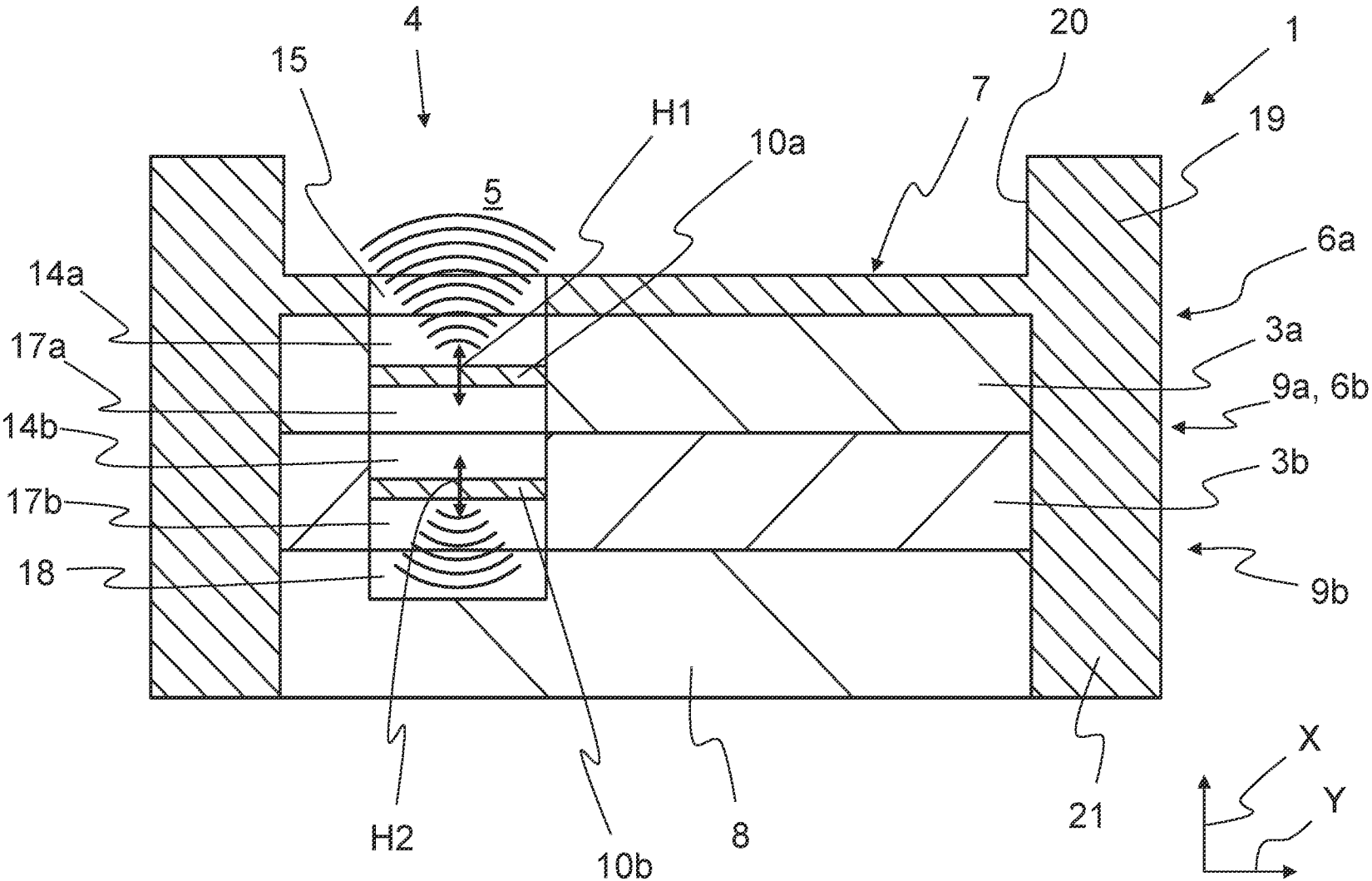
FIG. 2 shows a schematic sectional view of a test device for testing a microphone, with two test loudspeakers.
Figure 4:
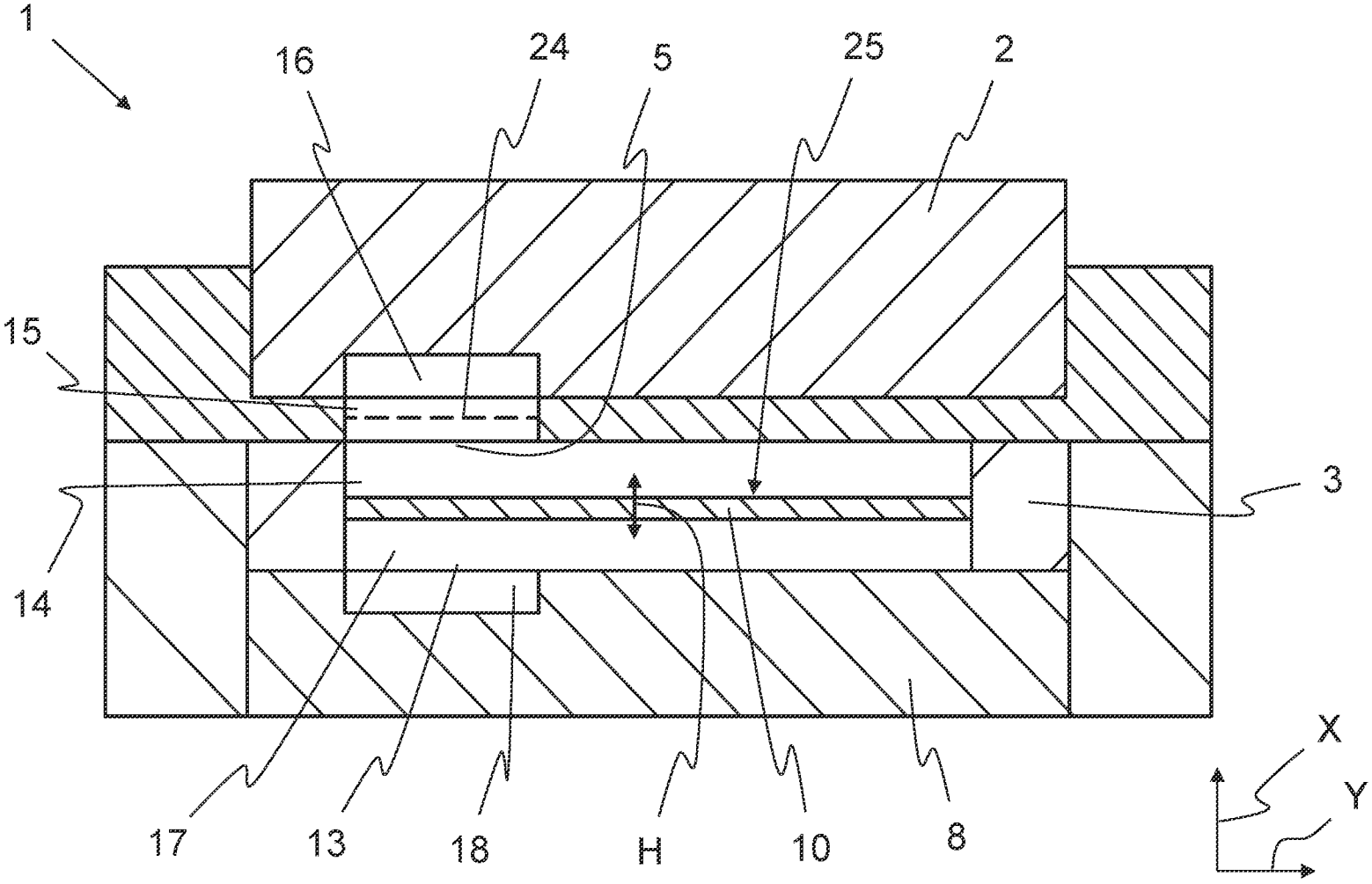
FIG. 4 shows a schematic sectional view of a test device for testing a microphone.

The test device 1 has an axial direction X and a transverse direction Y perpendicular thereto, which respective directions are schematically indicated in each of FIGS. 1, 2 and 4.

The test device 1 includes at least one test loudspeaker 3 for generating a test tone which is schematically represented in FIG. 1 for example by four arcuately parallel lines that generally are designated by the numeral 4. The test tone 4 is detected by the microphone 2 to be tested. On the basis of an evaluation, it can be ascertained whether the microphone 2 functions correctly. For example, the microphone 2 could pick up tones with distortion, and so the microphone 2 cannot be utilized.

Moreover, the test device 1 includes at least one test cavity 5, into which the test loudspeaker 3 can emit the test tone 4. In the exemplary embodiment shown here in FIG. 1 for example, the test cavity 5 is arranged on a first side 6 of the test loudspeaker 3.

In addition, the test device 1 includes a housing that defines at least one test compartment 7 that forms an accommodating region for receiving and accommodating the microphone 2 to be tested. The test compartment 7 is configured and disposed in such a way that the microphone 2 to be tested can be acoustically coupled to the test cavity 5. By acoustically coupled is meant that sound waves emitted from the microphone 2 to be tested can travel into the test cavity 5. In this exemplary embodiment, the compartment 7 also faces the first side 6 of the test loudspeaker 3 and is arranged on the first side 6. Therefore, the microphone 2 to be tested, when located in the compartment 7 of the test device 1, and the test cavity 5 are arranged in audio communication with each other on the same side, namely the first side 6, of the test loudspeaker 3.

The compartment 7 is also arranged and/or designed in such a way that, when the microphone 2 to be tested is arranged in the compartment 7, the microphone 2 is coupled to the test cavity 5 and/or is connected thereto. The microphone 2 to be tested can therefore detect the test tone 4 emitted from the test loudspeaker 3 into the test cavity 5.

Moreover, as schematically shown in FIG. 1 for example, the test device 1 can have a top side 22 and an underside 23. The compartment 7 and the microphone 2 to be tested, for example, are arranged at the top side 22. The reference microphone 8, for example, is arranged at the underside 23.

According to the present exemplary embodiment of FIG. 1, the test device 1 includes an accommodating device 19, which forms part of the housing that defines the compartment 7. The accommodating device 19 can include, for example, a recess 20 (shown here) that defines the compartment 7 into which the microphone 2 to be tested can be accommodated in a form-locking manner, at least in the transverse direction Y. The accommodating device 19 and/or the test device 1 can also include a fixing device (not shown here), by means of which the microphone 2 to be tested can be fixed in the compartment 7, in particular in a force-locked and/or form-locking manner.

On the basis of an evaluation of the signal detected by the microphone 2 to be tested, it can be ascertained whether the microphone 2 functions as intended.

The test tone 4 can have, of course, multiple frequencies, a frequency progression, various sound levels, and/or a sound level progression, in order to test the microphone 2 at various frequencies and/or at various sound levels. Rather, the test tone 4 is not merely one single tone of a frequency, but rather a sequence of tones having highly diverse sound levels. A test sequence can last for a few seconds or more, of course. The test loudspeaker 3 can therefore also generate the test sequence. The test tone 4 can be a test sequence.

Moreover, as schematically shown in FIG. 1, the test device 1 includes a reference microphone 8. The reference microphone 8 represents a reference. With the aid of the reference microphone 8, furthermore, a check can be carried out to determine whether the test loudspeaker 3 has emitted the intended test tone 4. By means of the reference microphone 8, a reference signal of the test tone 4 emitted from the test loudspeaker 3 can therefore be ascertained. Thereupon, the reference signal can be compared with the signal detected by the microphone 2 to be tested. If the two signals match, for example, the correct functioning of the microphone 2 to be tested can be inferred.

In the exemplary embodiment shown here in FIG. 1, the reference microphone 8 is arranged on a second side 9 of the test loudspeaker 3. The second side 9 is arranged on the side of the test loudspeaker 3 opposite the first side 6.

Consequently, the microphone 2 to be tested, when located in the test device 1, is arranged on the first side 6 of the test loudspeaker 3 and the reference microphone 8 is arranged on the second side 9 of the test loudspeaker 3 opposite thereto. As a result, the test device 1, with the microphone 2 installed therein and ready to be tested, can be designed to be compact. As a result, a sandwich design is also formed, which is space-saving. Furthermore, this sandwich design has the advantage that the test device 1 must be open only at the first side 6 or the top side 22, or designed there in such a way that the test device 1 can be opened there, in order to be able to insert the microphone 2 to be tested into the compartment 7. The reference microphone 8 and/or the test loudspeaker 3 or the test device 1 can be encapsulated at the second side 9 or at the underside 23.

Furthermore, as schematically shown in FIG. 1, the test loudspeaker 3 includes a diaphragm 10, which can make the surrounding air vibrate, and so sound waves and, thereby, the test tone 4, can be formed. The diaphragm 10 is deflectable along a reciprocation axis H, which is schematically indicated by the oppositely pointing arrows. For this purpose, the test loudspeaker 3 includes an actuator (not shown here), for example, desirably a piezoelectric actuator. As shown here, the diaphragm 10 can oscillate in the direction of the first side 6 and the second side 9. In this exemplary embodiment, the reciprocation axis H is oriented along a direction that is parallel to the axial direction X.

Moreover, the test loudspeaker 3 and/or the diaphragm 10 are/is oriented so as to elongate in the transverse direction Y. As a result, the sound formed by the test loudspeaker 3 and/or by the diaphragm 10 can be emitted in the axial direction X. The test loudspeaker 3 and/or the diaphragm 10 extend(s) transversely, in particular perpendicularly, to the axial direction X of the test device 1.

According to the present exemplary embodiment schematically shown in FIG. 1, the test loudspeaker 3 is designed in such a way that it can form the test tone 4, which has two test tone components 11, 12. According to the present exemplary embodiment, a first test tone component 11 is radiated or emitted in the direction of the first side 6 of the test loudspeaker 3 and a second test tone component 12 is radiated or emitted in the direction of the second side 9 of the test loudspeaker 3. The first test tone component 11 is therefore directed in the direction of the microphone 2 to be tested. The second test tone component 12, however, is directed in the direction of the reference microphone 8.

The two test tone components 11, 12 are essentially identical to each other. Their amplitudes can be merely inverted. If the diaphragm deflects, namely, toward one of the two sides 6, 9, an overpressure arises there, which is reflected in the amplitude of the sound waves. An underpressure forms on the side 6, 9 opposite thereto, however, which is also reflected in the amplitude of the sound waves, although correspondingly opposite thereto. This can be taken into account in an evaluation of the reference signal with the signal of the microphone 2 to be tested.

The first test tone component 11 (shown here), furthermore, is emitted or radiated into the test cavity 5.

According to the present exemplary embodiment schematically shown in FIG. 1, the test device 1 has a reference cavity 13. The test tone 4 can also be emitted or radiated into the reference cavity 13. Furthermore, the reference microphone 8 is acoustically coupled to the reference cavity 13, in order to be able to detect the test tone 4 situated therein. The second test tone component 12 (shown here) is emitted into the reference cavity 13.

Here, the reference cavity 13 is arranged on the side of the test loudspeaker 3 opposite the test cavity 5. The reference cavity 13 is arranged on the second side 9 of the test loudspeaker 3.

Moreover, as shown in this exemplary embodiment in FIG. 1, the diaphragm 10 of the test loudspeaker 3 is arranged between the test cavity 5 and the reference cavity 13. The diaphragm 10 can also separate the test cavity 5 and the reference cavity 13, in particular, in an air-tight manner.

According to the present exemplary embodiment in FIG. 1, the test loudspeaker 3 also has a front volume 14. Here, the test cavity 5 is at least partially formed by the front volume 14.

In addition, the accommodating device 19 of the housing that defines the compartment 7 also defines a passage 15 that connects the test cavity 5 to the compartment 7. Additionally or alternatively, the test cavity 5, as shown here in FIG. 1, is at least partially formed by the passage 15. The passage 15 also encompasses a volume.

Additionally or alternatively, the microphone 2 to be tested also includes a first detection volume 16 within the compartment 7. Additionally or alternatively, the test cavity 5, as shown here, can be at least partially formed by the first detection volume 16.

According to the present exemplary embodiment in FIG. 1, the front volume 14, the passage 15, and the first detection volume 16 form the test cavity 5.

It is advantageous, as shown here in FIG. 1, when the walls of the housing that define the front volume 14, the passage 15, and/or the first detection volume 16 are coaxial and/or congruent with one another. As a result, edges between the transitions in such walls are avoided, which edges otherwise would scatter the sound waves. Since the first detection volume 16 belongs to the microphone 2 to be tested, the front volume 14 and/or the passage 15 can also be adapted to the first detection volume 16.

Moreover, the test loudspeaker 3 according to the present exemplary embodiment in FIG. 1 includes a back volume 17. Here, the reference cavity 13 is at least partially formed by the back volume 17.

Furthermore, in the embodiment depicted in FIG. 1, the reference microphone 8 includes a second detection volume 18. Additionally or alternatively, the reference cavity 13 can be formed by the second detection volume 18.

According to the present exemplary embodiment in FIG. 1, the reference volume 13 is formed by the back volume 17 and the second detection volume 18.

According to the present exemplary embodiment in FIG. 1, the test device 1 includes a lower housing 21. As shown here, the test loudspeaker 3 and the reference microphone 8 are accommodated in the lower housing 21. Furthermore, the lower housing 21 is connected to the accommodating device 19. The housing can encompass the compartment 7 and the lower housing 21, however. The lower housing 21 can also extend completely across the underside 23, and so, for example, the reference microphone 8 is also encapsulated within the housing.

Furthermore, it is advantageous when the test cavity 5 and/or the reference cavity 13 are/is designed to be as small as possible. As a result, a sound pressure in the test cavity 5 and/or the reference cavity 13 is increased, and so the microphone 2 can be better tested and/or the reference microphone 8 can ascertain stronger signals.

Features that have already been described with reference to the preceding figure are not explained once more, for the sake of simplicity. Furthermore, features can also be first described in the following figures. Moreover, identical reference characters are utilized for identical features, for the sake of simplicity. In addition, to avoid undue complication of the figures, not all features may be shown again in the following figures, for the sake of clarity. Features shown in one or several of the preceding figures can also be present in one or several of the following figures, however. Furthermore, for the sake of simplicity, features can also be described first in one or several of the following figures.

Nevertheless, features that are first shown in one or several of the following figures can also be already present in a preceding figure.

FIG. 2 shows a test device 1 for testing the microphone 2, with two test loudspeakers 3*a*, 3*b*.

According to the present exemplary embodiment shown in FIG. 2, the two test loudspeakers 3*a*, 3*b* are arranged one above the other in the axial direction X. As a result, when test tones 4 are emitted at the same time from both test loudspeakers 3*a*, 3*b*, then a sound pressure in the test cavity 5 can be increased.

The two test loudspeakers 3*a*, 3*b* each have a diaphragm 10*a*, 10*b*, respectively. The first diaphragm 10*a* can be deflected along the first reciprocation axis H1 and the second diaphragm 10*b* can be deflected along the second reciprocation axis H2. The two reciprocation axes H1, H2 are oriented in parallel to one another. During the operation of the two test loudspeakers 3*a*, 3*b*, it is advantageous when the two diaphragms 10*a*, 10*b* move synchronously, and so the generated sound waves strengthen. Here, the two reciprocation axes H1, H2 are arranged in parallel to the axial direction X once again.

The first test loudspeaker 3*a* and/or the second test loudspeaker 3*b* have/has the front volume 14*a*, 14*b* and/or a back volume 17*a*, 17*b*, respectively.

According to the present exemplary embodiment in FIG. 2, the first test loudspeaker 3*a* has the first front volume 14*a* and the first back volume 17*a*. According to the present exemplary embodiment in FIG. 2, the second test loudspeaker 3*b* has the second front volume 14*b* and the second back volume 17*b*.

Since the two test loudspeakers 3*a*, 3*b* are arranged one above the other, the first back volume 17*a* of the first test loudspeaker 3*a* is arranged above the second front volume 14*b* of the second test loudspeaker 3*b*. At least the first back volume 17*a* of the first test loudspeaker 3*a* and the second front volume 14*b* of the second test loudspeaker 3*b* are formed coaxially and/or congruently with one another.

Furthermore, the microphone 2 to be tested is not shown here in FIG. 2. The test cavity 5 is shown above the compartment 7 here in FIG. 2. The first front volume 14*a* of the first test loudspeaker 3*a*, the passage 15 defined in the accommodating device 19 if the housing and/or the area above the compartment 7 form the test cavity 5 here. If the microphone 2 to be tested is inserted into the compartment 7, the microphone 2 is thereby also inserted into the test cavity 5 and/or the test cavity 5 forms as a result.

Furthermore, the lower housing 21 and the accommodating device 19 are shown here designed as one piece. Additionally or alternatively, the lower housing 21 and the accommodating device 19 can also be designed as one piece in the test device 1 from FIG. 1 and/or at least one of the following figures. Therefore, the lower housing 21 can include the accommodating device 19 or the accommodating device 19 can include the lower housing 21.

Features that have already been described with reference to the preceding figure are not explained once more, for the sake of simplicity. Furthermore, features can also be first described in the following figures. Moreover, identical reference characters are utilized for identical features, for the sake of simplicity. In addition, not all features may be shown again in the following figures, for the sake of clarity. Features shown in one or several of the preceding figures can also be present in one or several of the following figures, however. Furthermore, for the sake of simplicity, features can also be described first in one or several of the following figures. Nevertheless, features that are first shown in one or several of the following figures can also be already present in a preceding figure.

Figure 3:
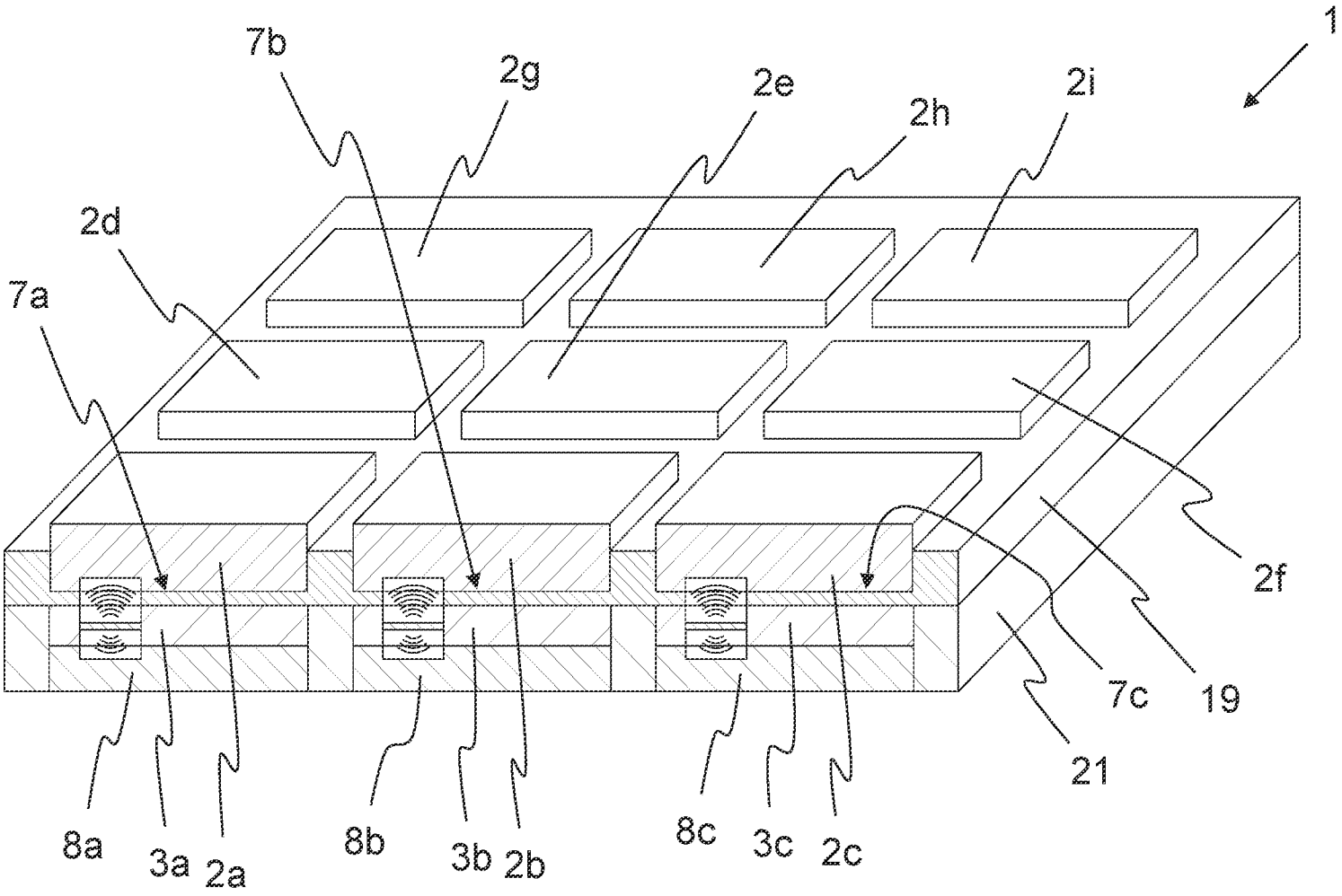
FIG. 3 shows a schematic sectional view of a test device for testing multiple microphones.

FIG. 3 shows an embodiment of a test device 1 for testing multiple microphones 2*a*-2*i*. The three front microphones 2*a*-2*c* are shown in a cutaway view here. Reference is made to FIGS. 1 and 2 for a precise description of the test device 1. The test device 1 shown here in FIG. 3 for testing multiple microphones 2*a*-2*i* is essentially a replication of the test devices from FIGS. 1 and/or 2. The test device 1 includes multiple compartments 7, wherein only the three compartments 7*a*-7*c* are shown here. According to the present exemplary embodiment in FIG. 3, at least one respective test loudspeaker 3*a*-3*i* is arranged in the test device 1 for each respective microphone 2*a*-2*i* to be tested. As shown here, the test device 1 includes a respective test loudspeaker 3*a*-3*i* for each respective microphone 2*a*-2*i* to be tested. Additionally or alternatively, two or several test loudspeakers 3 can also be assigned in a stacked alignment as shown in FIG. 2 to each of some microphones 2*a*-2*i* to be tested.

Furthermore, a reference respective microphone 8*a*-8*i* is assigned to each respective microphone 2*a*-2*i* to be tested.

Multiple microphones 2 can be tested simultaneously with the test device 1 shown here in FIG. 3.

The test device 1 in FIG. 3 is designed in such a way that the microphones 2*a*-2*i* to be tested are arranged next to one another, in particular in an array organized in a planar manner.

FIG. 4 shows an embodiment of a test device 1 for testing a microphone 2. For the sake of simplicity, not all features are labeled with a reference character here. In addition, to avoid prolix repetition, features that have already been described in one or several of the preceding figures are not explained once more.

In this exemplary embodiment in FIG. 4, the diaphragm 10 is designed to be larger in comparison to the embodiments depicted in the preceding figures. Therefore, a higher sound pressure can be generated.

In particular, the at least one diaphragm 10 of the embodiment of FIG. 4 has an area 25, which is larger than a cross-sectional area 24 of the passage 15 in the axial direction X. The area 25 of the diaphragm 10 is parallel to the cross-sectional area schematically represented by the dashed line designated by the numeral 24. Additionally or alternatively, the area 25 of the diaphragm 10 can also be larger than the cross-sectional area 24 of the first detection volume 16. Preferably, the area 25 is the one-sided area of the diaphragm 10, since only the area 25 facing the appropriate volume or the cavity 5 acts to generate sound.

Additionally or alternatively, as shown in FIG. 4, the area 25 of the diaphragm 10 can also be larger than the cross-sectional area 24 of the second detection volume 18.

Additionally or alternatively, as shown in FIG. 4, the area 25 of the diaphragm 10 can also be larger than the cross-sectional area 24 of the front volume 14.

Additionally or alternatively, as shown in FIG. 4, the area 25 of the diaphragm 10 can also be larger than the cross-sectional area 24 of the back volume 17.

Additionally or alternatively, as shown in FIG. 4, the area 25 of the diaphragm 10 can also be larger than the cross-sectional area 24 of the test cavity 5.

Additionally or alternatively, as shown in FIG. 4, the area 25 of the diaphragm 10 can also be larger than the cross-sectional area 24 of the reference cavity 13.

Here in the embodiment depicted in FIG. 4, the cross-sectional area 24 is indicated only for the passage 15, for the sake of clarity. Nevertheless, the cross-sectional area 24 is also defined for the other volumes/cavities 16, 18, 14, 17, 5, 13. In particular, the corresponding cross-sectional areas 24 are oriented in parallel to the area 25 of the diaphragm 10 and in parallel to the diaphragm 10.

This has the advantage—explained with reference to the passage 15 by way of example—that the sound waves generated by the larger diaphragm 10 pass through a passage 15 having a smaller cross-section in order to reach the microphone 2 to be tested. The sound pressure reaching the microphone 2 to be tested via the narrower passage 15 than the full extent of the area of the diaphragm is increased as a result.

Only one diaphragm 10 is shown in the present exemplary embodiment here in FIG. 4. Moreover, the test device 1 can also include multiple diaphragms 10, for example, of multiple test loudspeakers 3. Consequently, each diaphragm 10 can have an area 25, which is larger than the cross-sectional area 24 of the front volume 14, of the passage 15, of the back volume 17, of the test cavity 5, of the reference cavity 13 of the first detection volume 16 and/or of the second detection volume 18 in the axial direction X. Alternatively in an embodiment with multiple diaphragms 10, only the area 25 of fewer than all of the multiple diaphragms 10 can be formed larger than the cross-sectional area 24 of the front volume 14, of the passage 15, of the back volume 17, of the test cavity 5, of the reference cavity 13 of the first detection volume 16 and/or of the second detection volume 18.

Moreover, according to the present exemplary embodiment in FIG. 4, the volume of the front volume 14 is larger than a volume of the passage 15 and/or of the first detection volume 16. Consequently, the sound pressure that reaches the microphone 2 is increased by being forced through the smaller volume of the passage 15 than the full extent of the front volume 14 of the diaphragm 10.

In addition, according to the present exemplary embodiment in FIG. 4, the volume of the back volume 17 is larger than the volume of the second detection volume 18. The sound pressure is similarly increased as a result thereof as well.

Even though an embodiment of the test device 1 has multiple test loudspeakers 3, the corresponding volumes of the front volumes 14 and/or of the corresponding back volumes 17 can be larger than the volumes of the passage 15, of the first detection volume 16, and of the second detection volume 18.

According to FIG. 4, the passage 15, the first detection volume 16, and the second detection volume 18 are arranged or oriented non-concentrically or non-coaxially with the front volume 14, the back volume 17, the test loudspeaker 3, and the diaphragm 10. The passage 15, the first detection volume 16, and the second detection volume 18 are arranged offset in the transverse direction over a portion of one end of each of the front volume 14 and the back volume 17, as shown here in FIG. 4.

In an alternative exemplary embodiment not depicted in FIG. 4, the passage 15, the first detection volume 16 and/or the second detection volume 18 can be arranged or oriented concentrically or coaxially with the larger front volume 14, the back volume 17, the test loudspeaker 3, and/or the diaphragm 10 shown in FIG. 4.

The present invention is not limited to the represented and described exemplary embodiments. Modifications within the scope of the claims are also possible, as is any combination of the features, even if they are represented and described in different exemplary embodiments.

LIST OF REFERENCE NUMERALS

1 test device
2 microphone
3 test loudspeaker
4 test tone
5 test cavity
6 first side
7 compartment
8 reference microphone
9 second side
10 diaphragm
11 first test tone component
12 second test tone component
13 reference cavity
14 front volume
15 passage
16 first detection volume
17 back volume
18 second detection volume
19 accommodating device
20 recess
21 lower housing
22 top side
23 underside
24 cross-sectional area
25 area
H reciprocation axis
X axial direction
Y transverse direction

What is claimed is:

1. A test device for testing a microphone to be tested, the test device comprising:

a housing that defines a compartment configured for receiving the microphone to be tested;

a first test loudspeaker disposed in the housing and including a diaphragm and configured for emitting at least one test tone via the diaphragm;

a test cavity defined in the housing in communication with the compartment and disposed for receiving the at least one test tone that can be emitted from the first test loudspeaker, wherein the compartment is configured and disposed for acoustically coupling the test cavity to the microphone to be tested;

a reference microphone disposed in the housing and configured for ascertaining a reference signal for the at least one test tone to be emitted from the first test loudspeaker;

a reference cavity defined by the housing and separated from the test cavity and configured and disposed for receiving the at least one test tone that can be emitted from the first test loudspeaker, wherein the reference cavity is configured and disposed for acoustically coupling the reference microphone for ascertaining the reference signal; and wherein the diaphragm is disposed to separate the reference cavity from the test cavity and configured so that the at least one test tone can be emitted into both the test cavity and the reference cavity.

2. The test device of claim 1, wherein the compartment is arranged on a first side of the first test loudspeaker and the reference microphone is arranged on a second side of the first test loudspeaker opposite the first side.

3. The test device of claim 2, wherein the first test loudspeaker is designed and/or arranged in such a way to emit the at least one test tone in the direction of the first side of the first test loudspeaker and/or in the direction of the test cavity.

4. The test device of claim 2, wherein the first test loudspeaker is designed and/or arranged in such a way to emit the at least one test tone in the direction of the reference cavity, and/or that the reference cavity is arranged on the second side of the first test loudspeaker.

5. The test device of claim 1, wherein the compartment includes a fixing device configured to removably fix the microphone to be tested in the compartment in a force-locked manner or a form-locking manner.

6. The test device of claim 1, wherein the test cavity is at least partially formed by means of a front volume of the first test loudspeaker, by means of a passage that forms a region of the compartment and by means of a first detection volume of the microphone to be tested.

7. The test device of claim 1, wherein the reference cavity is at least partially formed by means of a back volume of the first test loudspeaker and a second detection volume of the reference microphone.

8. The test device of claim 1, wherein the test cavity and the reference cavity are spaced apart from one another in an axial direction and/or that the first test loudspeaker is arranged between the test cavity and the reference cavity.

9. The test device of claim 6, wherein the test cavity and the reference cavity are spaced apart from one another in an axial direction, wherein the front volume, the passage and the first detection volume are arranged coaxially with one another, and wherein the front volume, the passage, and the first detection volume have a round cross-section.

10. The test device of claim 7, wherein the test cavity and the reference cavity are spaced apart from one another in an axial direction (X), wherein the back volume and the second detection volume are arranged coaxially with one another, and wherein the back volume and the second detection volume have a round cross-section.

11. The test device of claim 1, wherein the test cavity and the reference cavity are spaced apart from one another in an axial direction, wherein the diaphragm of the first test loudspeaker is arranged oriented in a transverse direction that is orthogonal to the axial direction, wherein the diaphragm has a larger area than a cross-sectional area of the test cavity.

12. The test device of claim 6, wherein the front volume is filled by a first volume, wherein the passage is filled by a second volume, wherein the first volume of the front volume is greater than the second volume of the passage or a volume of the first detection volume.

13. The test device of claim 7, wherein the back volume is filled by a first volume, wherein the second detection volume is filled by a second volume, and wherein the first volume of the back volume is greater than the second volume of the second detection volume.

14. A test device for testing microphone to be tested, the test device comprising:

a housing that defines a compartment configured for receiving the microphone to be tested;

a first test loudspeaker disposed in the housing and configured for emitting at least one test tone;

a test cavity defined in the housing in communication with the compartment and disposed for receiving the at least one test tone that can be emitted from the first test loudspeaker, wherein the compartment is configured and disposed for acoustically coupling the test cavity to the microphone to be tested;

a reference microphone disposed in the housing and configured for ascertaining a reference signal for the at least one test tone to be emitted from the first test loudspeaker;

a reference cavity defined by the housing and separated from the test cavity and configured and disposed for receiving the at least one test tone that can be emitted from the first test loudspeaker, wherein the reference cavity is configured and disposed for acoustically coupling the reference microphone for ascertaining the reference signal; and a second test loudspeaker having a back volume and disposed in the housing in the axial direction above the first test loudspeaker, wherein the back volume of the second test loudspeaker is arranged coaxially with the front volume of the first test loudspeaker; and wherein the test cavity and the reference cavity are spaced apart from one another in an axial direction and/or that the first test loudspeaker is arranged between the test cavity and the reference cavity.

15. The test device of claim 1, wherein the compartment is configured for receiving a plurality of microphones to be tested, and wherein the compartment is configured for accommodating each of the plurality of microphones to be tested arranged next to one another in a planar manner.

16. The test device of claim 15, further comprising for each of the respective microphone to be tested of the plurality of microphones to be tested, a respective separate test loudspeaker, a respective separate test cavity, a respective separate reference microphone, and a respective separate reference cavity.

17. The test device of claim 1, wherein the first test loudspeaker is a MEMS loudspeaker or an electrodynamic loudspeaker, and wherein the reference microphone is a MEMS microphone, an electrostatic microphone, or a condenser microphone.

* * * * *